US008035469B2

(12) United States Patent
Okamoto et al.

(10) Patent No.: US 8,035,469 B2
(45) Date of Patent: Oct. 11, 2011

(54) STATIONARY INDUCTION APPARATUS FIXING STRUCTURE AND FIXING MEMBER

(75) Inventors: Tadayuki Okamoto, Saitama (JP); Kensuke Maeno, Saitama (JP)

(73) Assignee: Tamura Corporation, Tokyo (JP)

( * ) Notice: Subject to any disclaimer, the term of this patent is extended or adjusted under 35 U.S.C. 154(b) by 69 days.

(21) Appl. No.: 12/524,558

(22) PCT Filed: Jan. 24, 2008

(86) PCT No.: PCT/JP2008/000080

§ 371 (c)(1),
(2), (4) Date: Sep. 16, 2009

(87) PCT Pub. No.: WO2008/093492

PCT Pub. Date: Aug. 7, 2008

(65) Prior Publication Data

US 2010/0026434 A1 Feb. 4, 2010

(30) Foreign Application Priority Data

Jan. 30, 2007 (JP) ..... 2007-020146

(51) Int. Cl.
*H01F 27/06* (2006.01)

(52) U.S. Cl. ..... 336/65; 336/67; 336/196; 336/197; 336/199

(58) Field of Classification Search ..... 336/65, 336/67, 196, 197, 199
See application file for complete search history.

(56) References Cited

U.S. PATENT DOCUMENTS

| | | | | |
|---|---|---|---|---|
| 1,745,812 | A * | 2/1930 | Ready | 336/205 |
| 1,961,761 | A * | 6/1934 | Hendricks, Jr. | 336/197 |
| 2,264,057 | A * | 11/1941 | Treanor | 336/197 |
| 2,351,097 | A * | 6/1944 | Boeringer | 336/92 |
| 2,490,506 | A * | 12/1949 | Broverman | 336/67 |
| 2,897,463 | A * | 7/1959 | Denham | 336/65 |
| 3,144,503 | A * | 8/1964 | Fischer | 174/535 |
| 3,156,885 | A * | 11/1964 | Koza | 336/197 |
| 3,682,467 | A * | 8/1972 | Heinrich | 269/88 |
| 4,009,461 | A * | 2/1977 | Usry | 336/197 |
| 4,050,127 | A * | 9/1977 | Bodem et al. | 407/107 |
| 4,055,826 | A * | 10/1977 | Franz | 336/100 |
| 4,148,532 | A * | 4/1979 | Inabayashi et al. | 384/261 |
| 4,746,825 | A * | 5/1988 | Phelon | 310/70 R |
| 4,958,818 | A * | 9/1990 | Buchter | 269/136 |
| 6,679,712 | B2 * | 1/2004 | Chang | 439/248 |
| 7,830,233 | B2 * | 11/2010 | Hrkac | 336/196 |

FOREIGN PATENT DOCUMENTS

JP 55-25358 2/1980

(Continued)

*Primary Examiner* — Anh Mai
*Assistant Examiner* — Joselito Baisa

(57) ABSTRACT

The present invention provides a fixing structure and a fixing member for a stationary induction apparatus, which can easily and inexpensively be assembled with a small number of constituent elements, and which are capable of reliable fixation. A fixing portion 4 which fixes the core 2 of a reactor to a case 1 is provided. The fixing portion 4 has a slide block 40 in contact with the core 2; a fixing bolt 42 which fixes the slide block 40 with respect to the case 1; and a slide base 41 provided between the slide block 40 and the case 1, and fixed to the case 1 together with the slide block 40. The slide block 40 and the slide base 41 have inclined faces 40*d*, 41*b* in mutual contact, and the slide block 40 has a first impelling portion 40*a* which impels the core 2 in a vertical direction and a second impelling portion 40*b* which impels the core 2 in a horizontal direction, according to fastening by the fixing bolt 42.

13 Claims, 20 Drawing Sheets

FOREIGN PATENT DOCUMENTS

| | | |
|---|---|---|
| JP | 61-27221 | 2/1986 |
| JP | 2004-241475 | 8/2004 |
| JP | 2005-072198 | 3/2005 |

* cited by examiner

STATIONARY INDUCTION APPARATUS FIXING STRUCTURE AND FIXING MEMBER

TECHNICAL FIELD

This invention relates to a fixing structure to fix a stationary induction apparatus such as, for example, a reactor on a support member, and in particular relates to a stationary induction apparatus fixing structure and fixing member with improvement in the impelling direction for fixation.

BACKGROUND ART

Various stationary induction apparatuses, such as reactors, voltage transformers, current transformers, and similar, comprising a coil and a core, are in use today. For example, reactors are connected to step-up circuits, inverter circuits, active filter circuits, and various other electrical circuits, in which the inductive reactance is used; reactors with various structures have been developed for diverse applications. Many reactors have a coil and core housed within a metal case with other insulating members or similar, in a structure which is packed with resin.

When a reactor housing a core and coil in a case is to be packed with resin, the core and coil must be reliably fixed with respect to the case. As one such mechanical structure, devices using a plate-shape spring member are known. For example, in the technology of Patent Document 1, a leaf spring with a U-shape cross-section is inserted between one side face of the core and an inner side face of the case, and by impelling one side face of the core in a horizontal direction by means of this leaf spring, the core is pressed against the case inner wall and fixed. And, in the technology of Patent Document 2, a plate-shape fitting called a retainer is positioned so as to press from the upper portion of the core in the vertical direction, and is fixed by connection of both ends with bolts to the case.

Patent Document 1: Japanese Patent Application Laid-open No. 2005-72198

Patent Document 2: Japanese Patent Application Laid-open No. 2004-241475

However, in the above-described technologies of the prior art, the direction in which the core is fixed is a single direction, so that there is the possibility of shifting or similar in directions in which the core is not fixed. In order to address this problem, it is conceivable that, in Patent Document 1 for example, a member may be provided separately for fixation from the vertical direction, and in Patent Document 2, a member may be provided separately for fixation from the horizontal direction. However, these methods entail an increase in the number of components and an increase in the number of assembly processes.

In particular, when a leaf spring or similar is to be reliably fixed with respect to the case, bolts must be fastened at a plurality of locations. However, in this case a plurality of bolts are necessary, and moreover a plurality of boss shapes for bolts must be provided in the case.

Further, in the above-described technology of the prior art, the core and coil are housed within a case, and after fixing with a leaf spring, packing with resin is performed. However, because the leaf spring has a thin plate shape, there is a large amount of space within the case other than the leaf spring, and the amount of resin packed is increased. Such an increase in the amount of packed resin results in increased manufacturing costs when the resin is comparatively expensive (as in the case of urethane resins, for example). In particular, when using a design in which there is pressing from above by a retainer as in Patent Document 2, there is still more space within the case, and costs are increased.

Further, when using a leaf spring for pressing, there is contact with the core in a linear area or a narrow area. Hence when using a laminated core or similar, manufactured by laminating silicon steel sheets or other materials, there is the possibility of local concentration of excessive force along the lamination direction.

DISCLOSURE OF THE INVENTION

This invention is proposed in order to resolve the above-described problems of the technology of the prior art, and has as an object the provision of a fixing structure and a fixing member for a stationary induction apparatus which comprise a small number of components, are inexpensive and can be assembled easily, and which enable reliable fixation.

In order to attain the above object, a stationary induction apparatus fixing structure of this invention, in which a stationary induction apparatus is fixed on a support member, has an abutting member which abuts the stationary induction apparatus, and a fixture which fixes the abutting member with respect to the support member by impelling the abutting member in a first direction, and is characterized in that a resolving portion, which resolves the impelling force due to the fixture such that the abutting member impels the stationary induction apparatus in a second direction different from the first direction, is provided between the abutting member and the support member.

In the above-described invention, the impelling force from the fixture is resolved into different directions by the resolving portion, and the abutting member impels the stationary induction apparatus from two directions, so that reliable fixation is possible with a small number of members. Fixation is possible solely through adjustment of the impelling force from the fixture, so that assembly is made easy.

Another mode is characterized in that the abutting member and the resolving portion have inclined portions which are in mutual contact.

By means of this mode, resolution of the impelling force is realized through the inclined portions, so that the configuration can be streamlined and simple.

Another mode is characterized in that the fixture is a fastening member which fastens and fixes the abutting member to the support member.

By means of this mode, fixation is possible merely by fastening using the fastening member, so that the assembly task and adjustment of the impelling force become easy.

Another mode is characterized in that the abutting member has a face which impels the stationary induction apparatus in the first direction, and a face which impels the stationary induction apparatus in the second direction.

By means of this mode, the core is pressed by faces from two directions, so that the force holding the core is distributed, and effects on the laminated core or similar due to local concentration are prevented.

Another mode is characterized in that the first direction is a vertical direction, and the second direction is a horizontal direction.

By means of this mode, two orthogonal side faces generally possessed by cores and similar can be impelled and pressed against, so that more reliable fixation is possible.

Another mode is characterized in that an elastic member is provided between the abutting member and the fixture.

By means of this mode, displacement of the stationary induction apparatus is absorbed by the elastic member, and fixation can be maintained.

Another mode is characterized in that the abutting member and the resolving portion are formed by a pair of block-shape members having inclined portions which are in mutual contact.

By means of this mode, due to the block shape of the members, the amount of packed resin can be reduced when packing the surroundings of the stationary induction apparatus with resin.

Another mode is characterized in that the resolving portion is formed integrally with the support member.

Another mode is characterized in that the resolving portion is formed integrally with a portion of the stationary induction apparatus.

By means of these modes, there is no longer a need for the resolving portion to be an independent member, so that the number of members can be reduced, and assembly can be made still easier.

Further, a stationary induction apparatus fixing member of this invention which fixes a stationary induction apparatus on a support member, has a slide block which abuts the stationary induction apparatus and a slide base provided between the slide block and the support member, and is characterized by having, between the slide block and the slide base, inclined faces which are in mutual contact such that when the slide block is impelled in a first direction, the stationary induction apparatus is impelled in the first direction and in a second direction different therefrom.

In the invention described above, the impelling force for fixation is resolved into different directions by inclined faces, and the sliding block impels the stationary induction apparatus from two directions, so that reliable fixation by a small number of members, which are the slide block and slide base, is possible.

As explained above, by means of this invention a fixing structure and a fixing member for a stationary induction apparatus can be provided which comprise a small number of components, are inexpensive and can be assembled easily, and which enable reliable fixation.

BEST MODE FOR CARRYING OUT THE INVENTION

Figure 1:
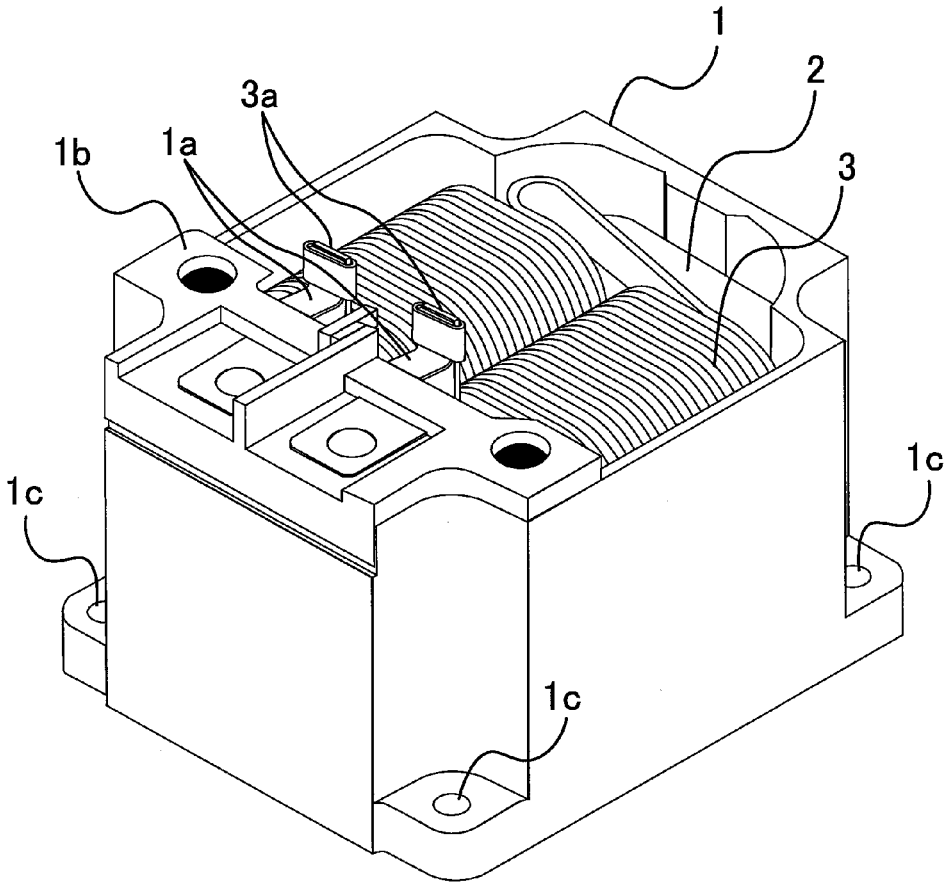
FIG. 1 is a perspective view showing the overall configuration of an aspect of the invention.

Next, aspects of the invention (hereafter simply "aspects") are explained in detail, referring to the drawings.

(Overall Configuration of Reactor: FIG. 1 Through FIG. 4)

Figure 2:
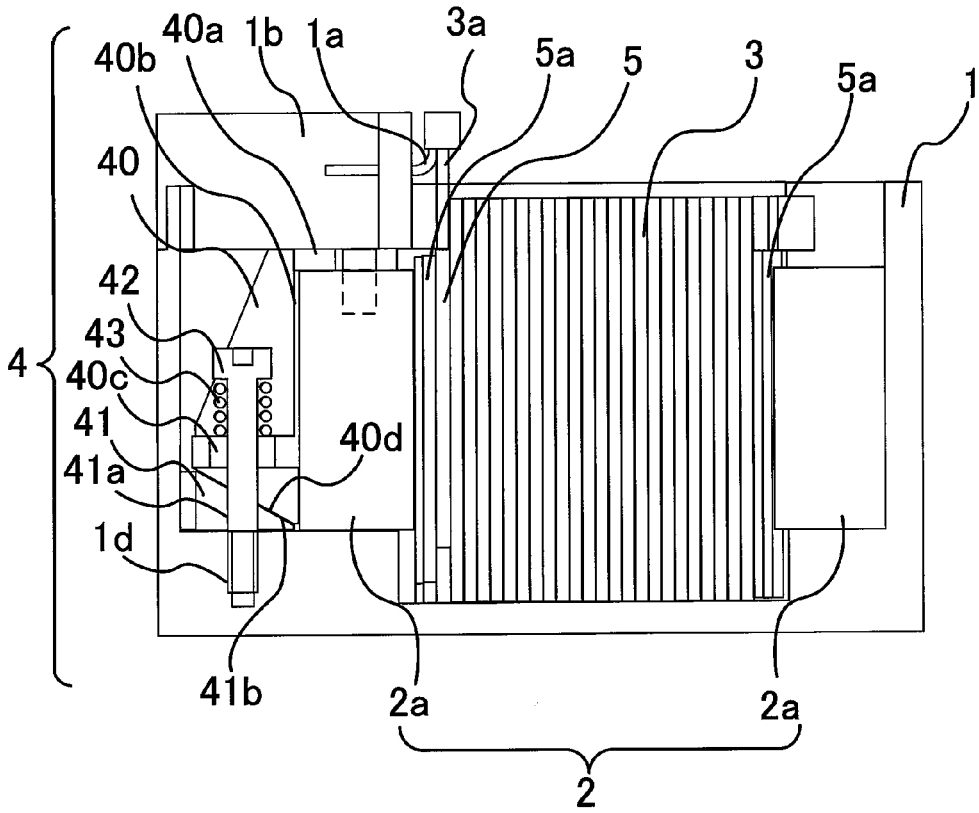
FIG. 2 is a cross-sectional view of the aspect of FIG. 1.
Figure 3:
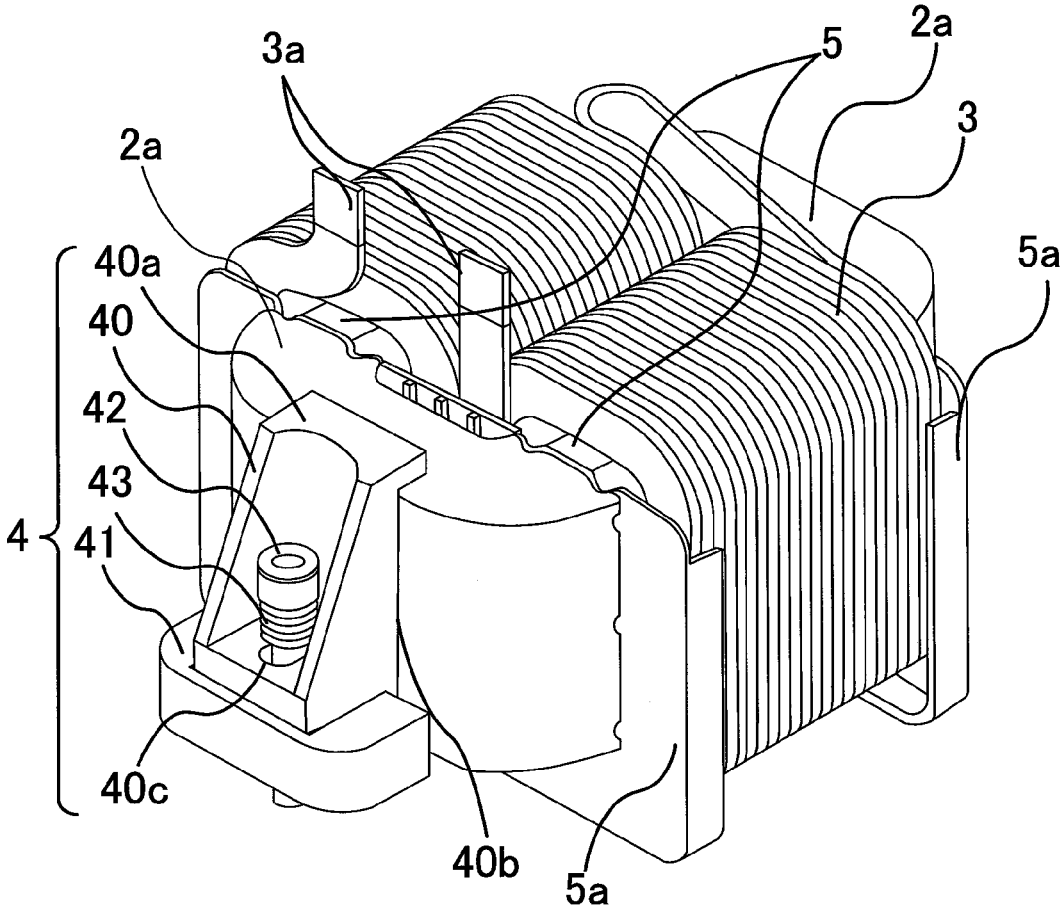
FIG. 3 is a perspective view showing the internal structure of the aspect of FIG. 1.
Figure 4:
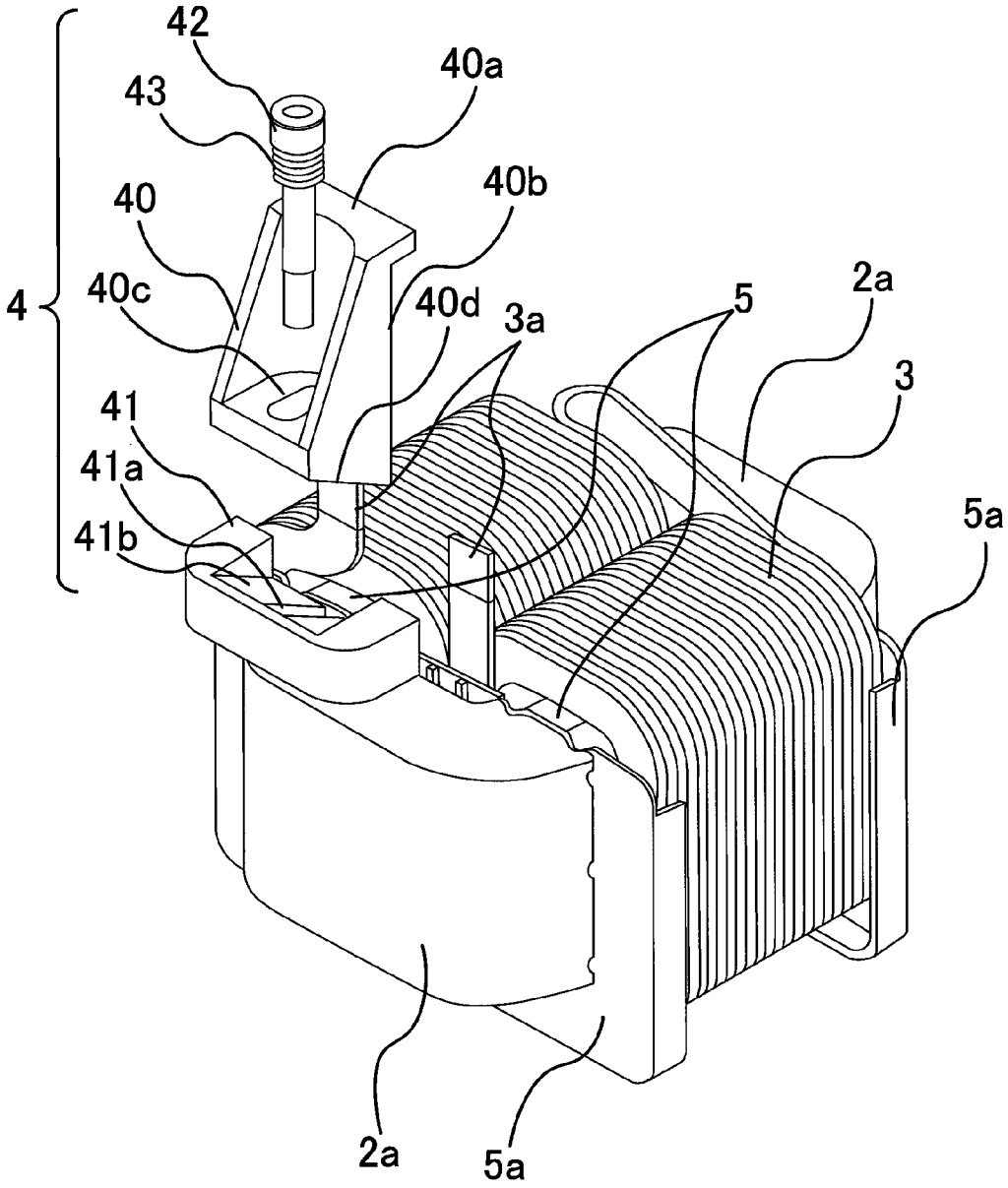
FIG. 4 is an exploded perspective view of the fixing portion of the aspect of FIG. 1.

First, the configuration of an aspect is explained referring to FIG. 1 through FIG. 4. FIG. 1 is an external perspective view of a reactor to which this aspect is applied, FIG. 2 is a cross-sectional view, FIG. 3 is a perspective view showing the internal structure, and FIG. 4 is an exploded perspective view of the fixing portion.

That is, as shown in FIG. 1, the reactor to which this aspect is applied is formed by housing a core 2 and coil 3 within a case 1. As shown in FIG. 2 through FIG. 4, the core 2 within the case 1 is fixed by the fixing portion 4. And, the interior of the case 1 is packed with a urethane or other resin (not shown) such that the end portion 3*a* of the coil 3 is exposed.

(Case Configuration: FIG. 1 and FIG. 2)

The case 1 is an aluminum alloy housing, the upper portion of which is open. On the upper edge of the case 1 are provided terminals 1*a* to which are connected the end portions 3*a* of the coil 3, and a terminal base 1*b* on which the terminals 1*a* are fixed. In the four corners of the outer bottom portion of the case 1 are formed holes 1*c* for fixing using screws. And, on the inner bottom portion of the case 1 is formed a fixing hole 1*d*, into which the tip of a fixing bolt 42 of the fixing portion 4, explained below, is screwed, as shown in FIG. 2.

(Core Configuration: FIG. 1 Through FIG. 4)

The core 2 comprises an outer core 2*a*, comprising U-shape magnetic members exposed at both ends of the coil 3, and an inner core (not shown) inserted into the coil 3. The inner core comprises a plurality of magnetic blocks. By providing ceramic plates between the outer core 2*a* and inner core, and between the plurality of magnetic blocks of the inner core, gaps are formed. Also, insulation is effected by providing a rectangular tube-shape bobbin 5 of epoxy glass between the coil 3 and the inner core. 5*a* are flange plates provided on the bobbin 5.

(Coil Configuration: FIG. 1 Through FIG. 4)

The coil 3 comprises rectangular wire covered with polyamide-imide. A pair of constituent portions of this coil 3 are wound in a rectangular tube shape with the rectangular wire in the width direction (edgewise winding), such that the axes are substantially parallel. The bobbin 5 and inner core are inserted into the coil 3 as explained above. The two end portions 3*a* of the coil 3 are stripped of the covering and are connected to the respective terminals 1*a* of the case 1.

(Fixing Portion Configuration: FIG. 2 Through FIG. 4)

The fixing portion 4 comprises a slide block 40, slide base 41, fixing bolt 42, and coil spring 43. The slide block 40 is an aluminum block-shape member equivalent to the abutting member of the claims, on the upper end of which is improved a first impelling portion 40*a* protruding in a horizontal direction. By causing the lower-side plane of this first impelling portion 40*a* to abut the upper face of the outer core 2*a*, the first impelling portion 40*a* is configured so as to impel downwards. A vertical-direction side face of the slide block 40 corresponding to a side face of the outer core 2*a* serves as a second impelling portion 40*b* impelling the side face of the outer core 2*a* in a horizontal direction.

And, a slide hole 40*c*, into which the fixing bolt 42 is inserted in the vertical direction, is formed in the slide block 40. This slide hole 40*c* is long in a horizontal direction (the direction of approach to and withdrawal from the core 2), as shown in FIG. 4, so as to accommodate movement of the slide block 40 in the horizontal direction. Further, an inclined face 40*d*, descending toward the side of the core 2, is formed in the bottom face of the slide block 40.

The slide base 41 is an aluminum block-shape member equivalent to the resolving portion of the claims, in which is formed a penetrating hole 41*a* into which the fixing bolt 42 is inserted in the vertical direction. In the upper portion of this slide base 41 is formed an inclined face 41*b*, descending toward the side of the core 2. This inclined face 41*b* is in contact with the inclined face 40*d* of the slide block 40 when the slide base 41 is enclosed between the bottom portion of the case 1 and the slide block 40.

The fixing bolt 42 is a shoulder bolt equivalent to the fixture and fastening member of the claims. This fixing bolt 42 penetrates the slide hole 40*c* of the slide block 40 and the penetrating hole 41*a* of the slide base 41, and by screwing the tip thereof into the hold 1*d* in the case 1, the slide block 40 and slide base 41 are fixed with respect to the case 1.

Further, the coil spring 43 is an elastic member provided between the head portion of the fixing bolt 42 and the slide block 40. This coil spring 43 absorbs displacement of the slide block 40 in the vertical direction when the impelling force due to displacement of the core 2 is transmitted to the slide block 40.

(Action)

Figure 5:
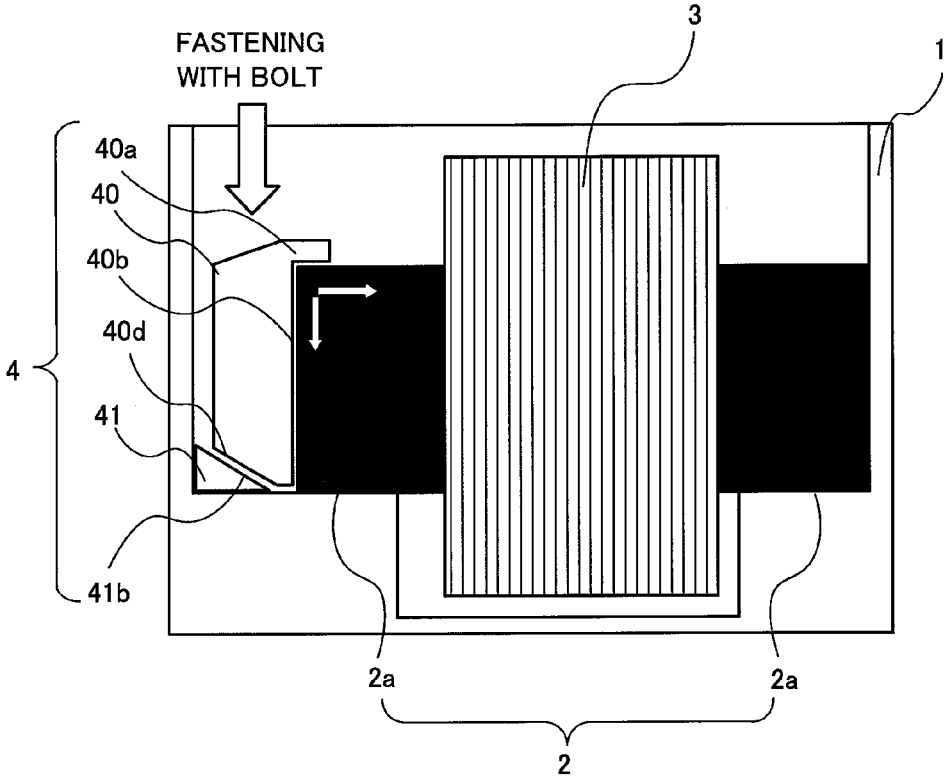
FIG. 5 is a simplified cross-sectional view showing the configuration of the aspect of FIG. 1.

Fixing action by the fixing portion 4 of this aspect as described above is explained, referring to the above FIG. 2 through FIG. 4 and to FIG. 5. FIG. 5 is a simplified cross-sectional view showing the action of the impelling forces in this aspect.

That is, as shown in FIG. 2 through FIG. 4, the screw portion of the fixing bolt 42 penetrates the slide hole 40*c* of the slide block 40 and the penetrating hole 41*a* of the slide base 41, and is screwed into the hole 1*d* of the case 1, to fix the slide block 40 and slide base 41 with respect to the case 1. At this time, the first impelling portion 40*a* of the slide block 40 abuts the upper face of the outer core 2*a*, and impels downward (see the small arrow in the figure). By this means, the outer core 2*a* is pressed against the inner bottom face of the case 1, and fixation in the vertical direction is effected.

Further, the force acting in the vertical direction due to fastening fixation of the fixing bolt 42 is resolved into a horizontal direction as well by the inclined face 40*d* of the slide block 40 and the inclined face 41*b* of the slide base 41 in contact therewith. Hence the slide block 40 moves, and the second impelling portion 40*b* impels the side face of the outer core 2*a* in a horizontal direction (see the small arrow in the figure). By this means, the outer core 2*a* is pressed against an inner side face of the case 1, and fixation in a horizontal direction is effected.

Further, after fixation by the fixing bolt 42, there are cases in which an impelling force from the side of the core 2 acts due to thermal stress arising from displacements due to temperature changes in the core 2 (differences in linear expansion coefficients), vibrations due to magnetic attractive forces, shocks from outside, and similar. In such cases, the horizontal-direction impelling force is absorbed by movement of the slide block 40 in the horizontal direction. At this time, due to the effect of the inclined faces 40*d* and 41*b*, the horizontal-direction force is resolved into the vertical direction as well, but the slide block 40 moves upward against the impelling force of the coil spring 43, and so this force is absorbed (see FIG. 16, FIG. 18, and FIG. 19, explained below). The impelling force due to vertical-direction displacement of the core 2 and coil 3 is similarly absorbed.

(Advantageous Results)

Advantageous results of the above aspect are explained below.

(Reduction of the Amount of Packed Resin)

First, in this aspect, the slide block 40 and slide base 41 formed in block shapes within the case 1 are used to fix the core 2, so that compared with cases in which thin plate-shape leaf springs are incorporated, or pressing from above with a leaf spring is performed, the amount of resin packed between the case 1 and the core 2 and coil 3 can be reduced. Hence manufacturing costs can be lowered.

(Reduction of Required Space)

Merely by fastening and fixing the slide block 40 and slide base 41 using a single fixing bolt 42, the core 2 can be impelled not only in the vertical direction but also in a horizontal direction and reliably fixed. Hence when a leaf spring is used for fixation in two directions, the fixing structure is small compared with cases which lead to a larger leaf spring and increases in the screw fixing portions, and the space required for the reactor as a whole can be reduced. The elastic member for absorption of displacement (the coil spring 43) can also be made smaller than a leaf spring or similar.

(Distribution of Pressing Load)

By setting the inclined faces 40*d* and 41*b* of the slide block 40 and slide base 41, the fastening force of the fixing bolt 42 can be efficiently distributed in the vertical direction and in the horizontal direction. Moreover, the impelling force from the side of the core 2 and coil 3 due to thermal stress, vibrations, shock, and similar can also be efficiently distributed in the horizontal direction and vertical direction, and can be absorbed and mitigated. Hence reliable fixation is possible using a smaller holding force than in the prior art.

The first impelling portion 40*a* and second impelling portion 40*b* of the slide block 40 can be brought into contact with broader areas of the core 2 than in the case of a leaf spring or similar, so that even when a laminated core or similar is used, adverse effects due to local concentration of the holding force are prevented.

(Facilitation of Assembly)

By using a single fixing bolt 42 to fasten the slide block 40 and slide base 41, the core 2 and coil 3 can be held. Hence assembly is made easy, and impelling force adjustment and similar are also easy.

(Other Aspects)

This invention is not limited to the above aspect, and the sizes, shapes, material, quantity and similar of the various members can be modified. For example, the invention also includes the various modes described below.

(Fixing Position)

Figure 6:
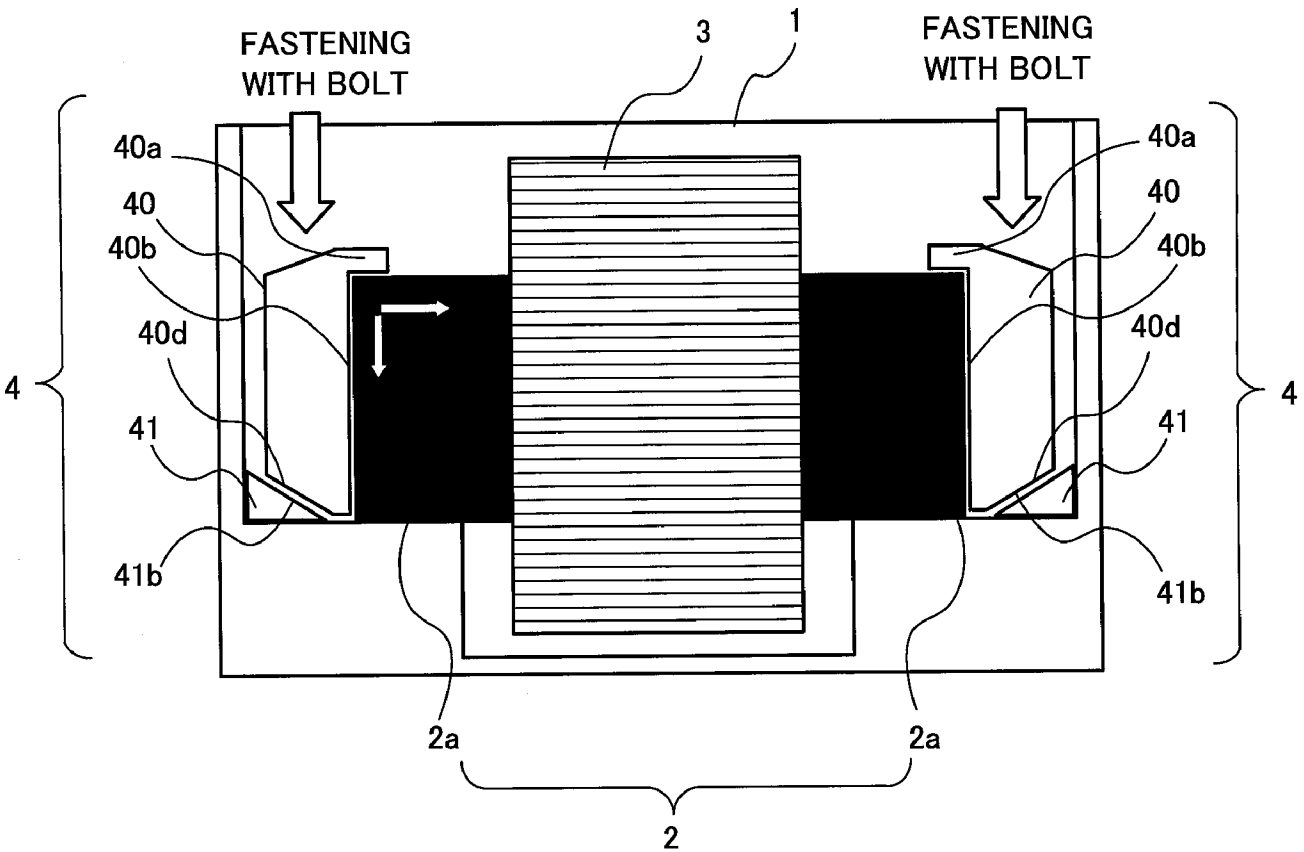
FIG. 6 is a simplified cross-sectional view showing an aspect of the invention in which the fixing portion is a pair of members.
Figure 7:
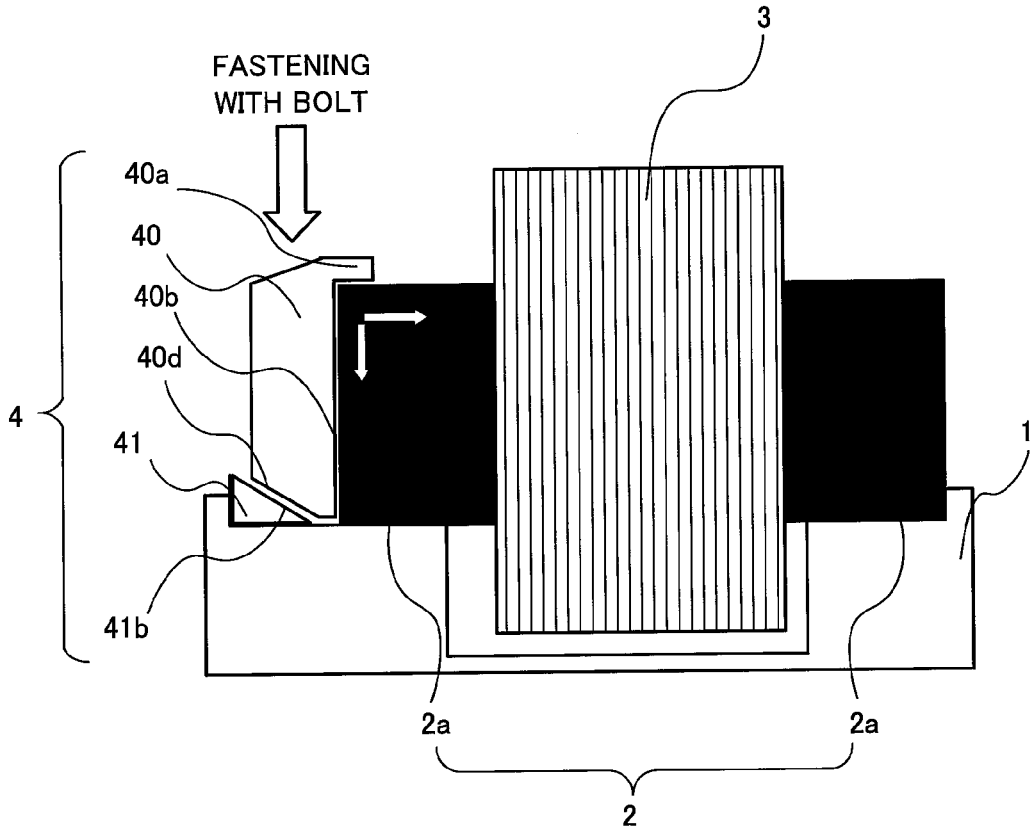
FIG. 7 is a simplified cross-sectional view showing an aspect of the invention in which a case side wall is omitted.

In the above aspect, only one of the outer core pieces 2*a* is fixed by pressing against the case 1, as shown in FIG. 5. However, the fixing position is not limited to this position. For example, as shown in FIG. 6, by fixing both outer core pieces 2*a* by means of fixing portions 4 with similar structures, firmer fixation and tolerance of a wider range of displacement may be realized. And, even in cases in which a side wall of the case 1 does not exist, as shown in FIG. 7, if a location exists for latching the outer core 2*a* on the side opposite the fixing portion 4, fixation is possible.

Figure 8:
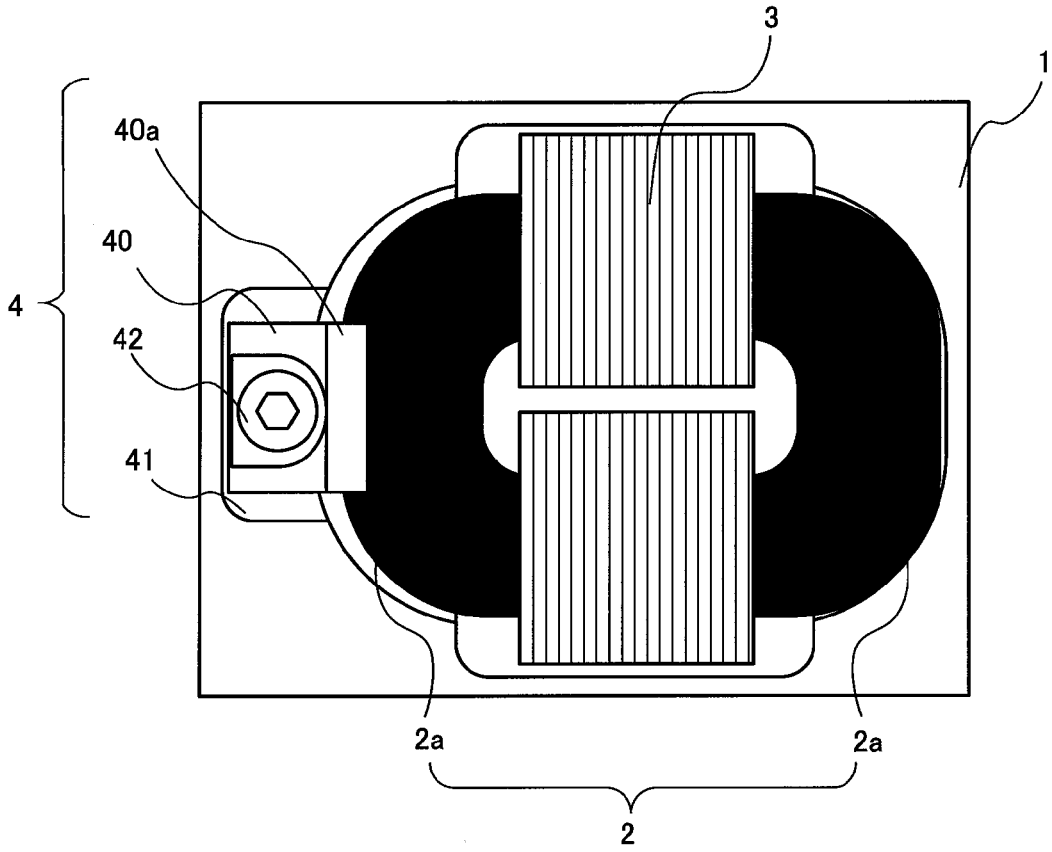
FIG. 8 is a simplified plane view of the aspect of FIG. 1.
Figure 9:
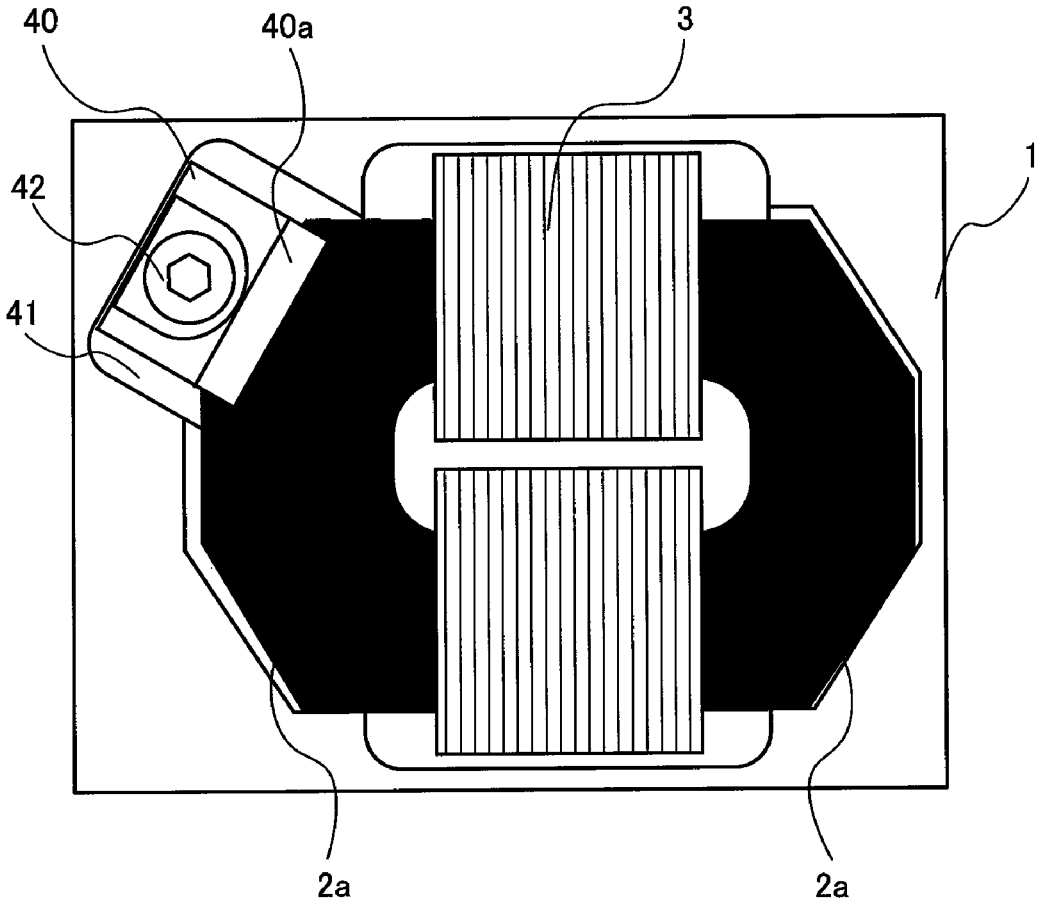
FIG. 9 is a simplified plane view showing an aspect of the invention in which the fixing position of the fixing portion is shifted.
Figure 10:
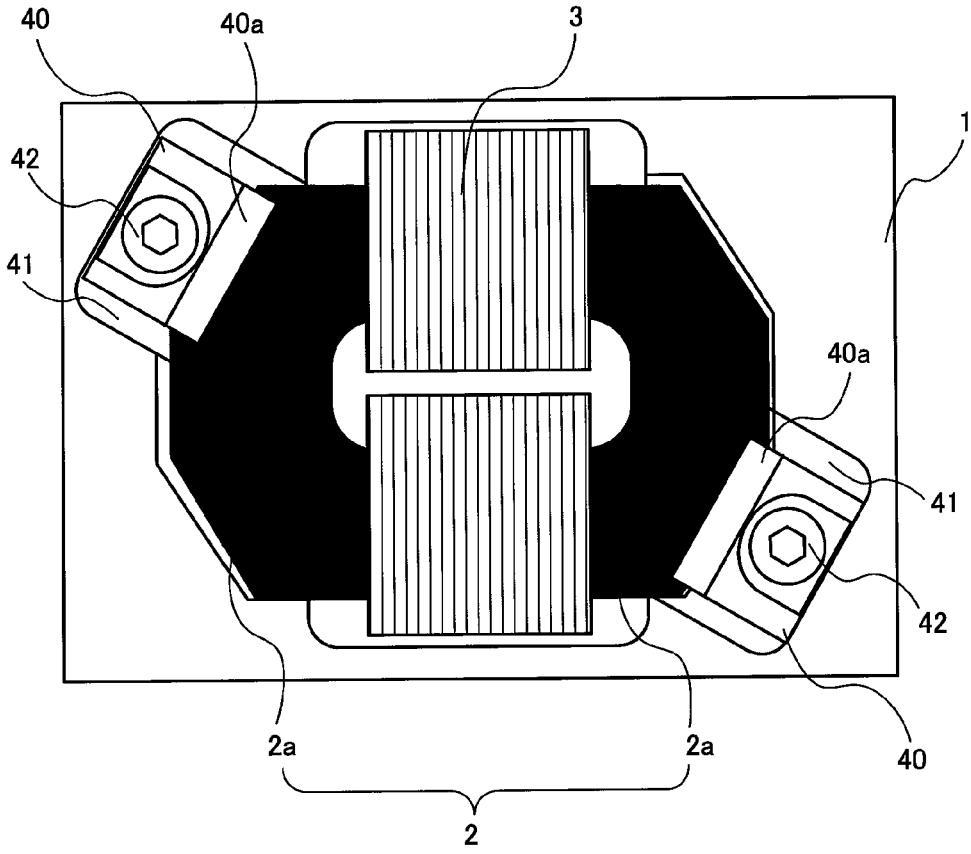
FIG. 10 is a simplified plane view showing an aspect of the invention in which the fixing position of the fixing portion is shifted, and the fixing portion is a pair of members.

Further, in the above aspect, fixation is performed by the fixing portion 4 at a position corresponding to the center of the outer core 2*a* as seen from above, as shown in FIG. 8. However, as shown in FIG. 9, fixation may be performed at an off-center position. Also, when fixation is performed using a plurality of fixing portions 4, as shown in FIG. 10, fixation may be performed at off-center positions. It is desirable that holding be possible in an axial direction passing through the center of gravity of the reactor.

Figure 11:
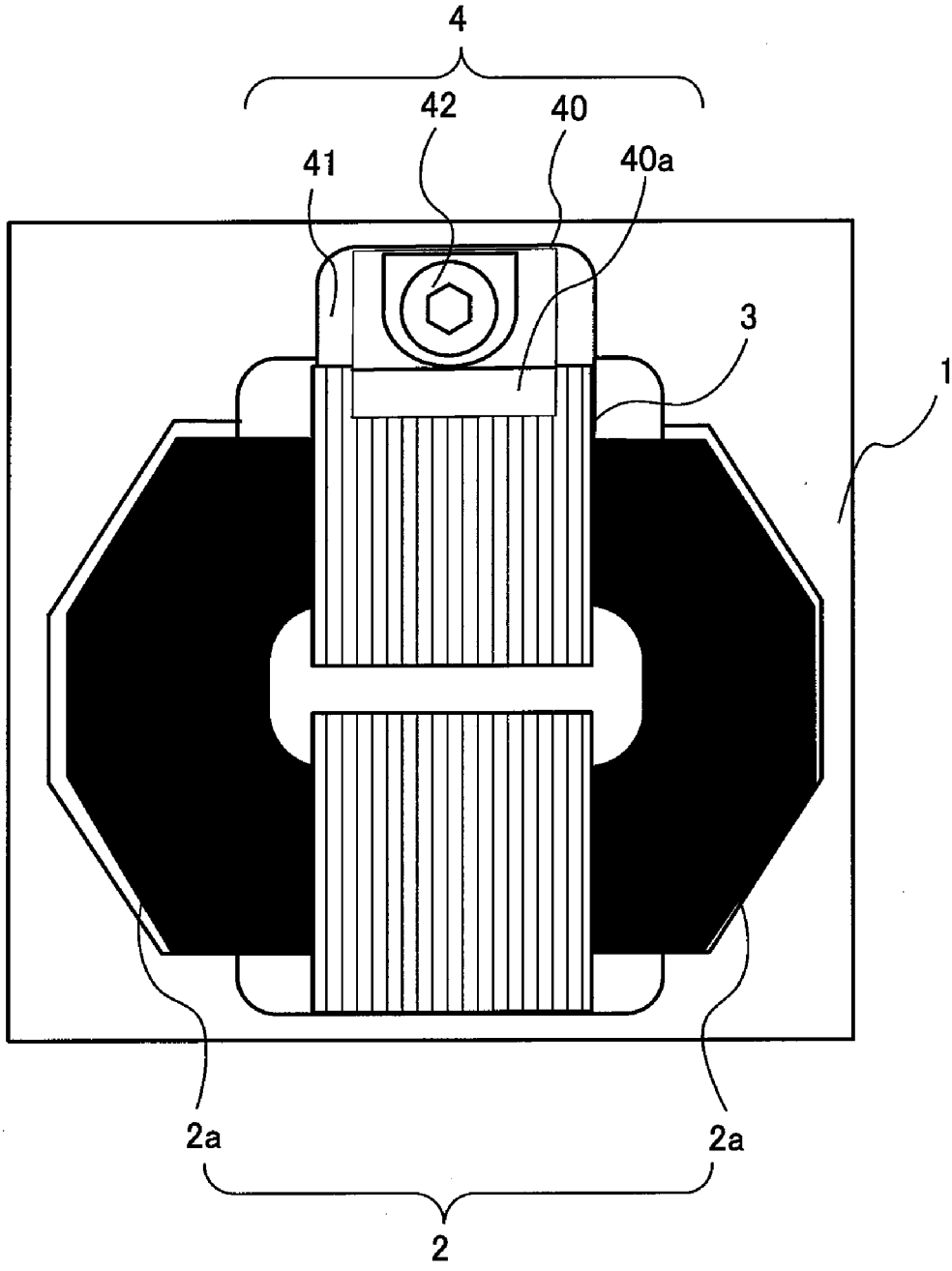
FIG. 11 is a simplified plane view showing an aspect of the invention in which the core is fixed by the fixing portion.

Further, the object of fixation is not limited to the core 2. For example, as shown in FIG. 11, a structure is possible in which the coil 3 is fixed. However, when fixing the coil 3, it is necessary to secure insulation between the fixing portion 4 and the coil 3.

(Fixation Shape)

Figure 12:
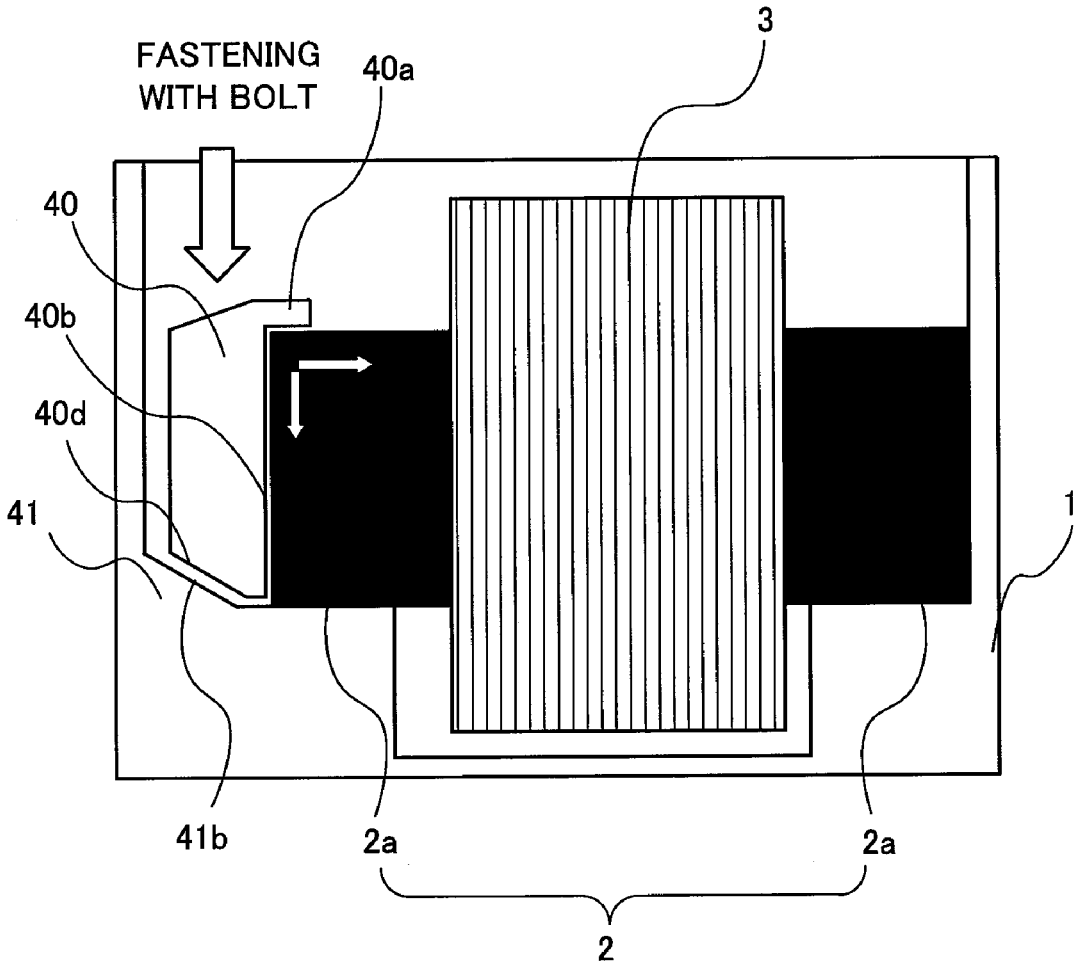
FIG. 12 is a simplified cross-sectional view showing an aspect of the invention in which the slide base is integrated with the case.

In the above aspects, the inclined face 41*b* in contact with the inclined face 40*d* of the slide block 40 is provided in the slide base 41, which is an independent member; however, by providing the inclined face 41*b* on another member which also serves as the slide base 41, the number of members may be reduced and assembly may be facilitated. For example, the inclined face 41*b* may be provided on the case 1, with the case 1 also serving as the slide base 41, as shown in FIG. 12.

Figure 13:
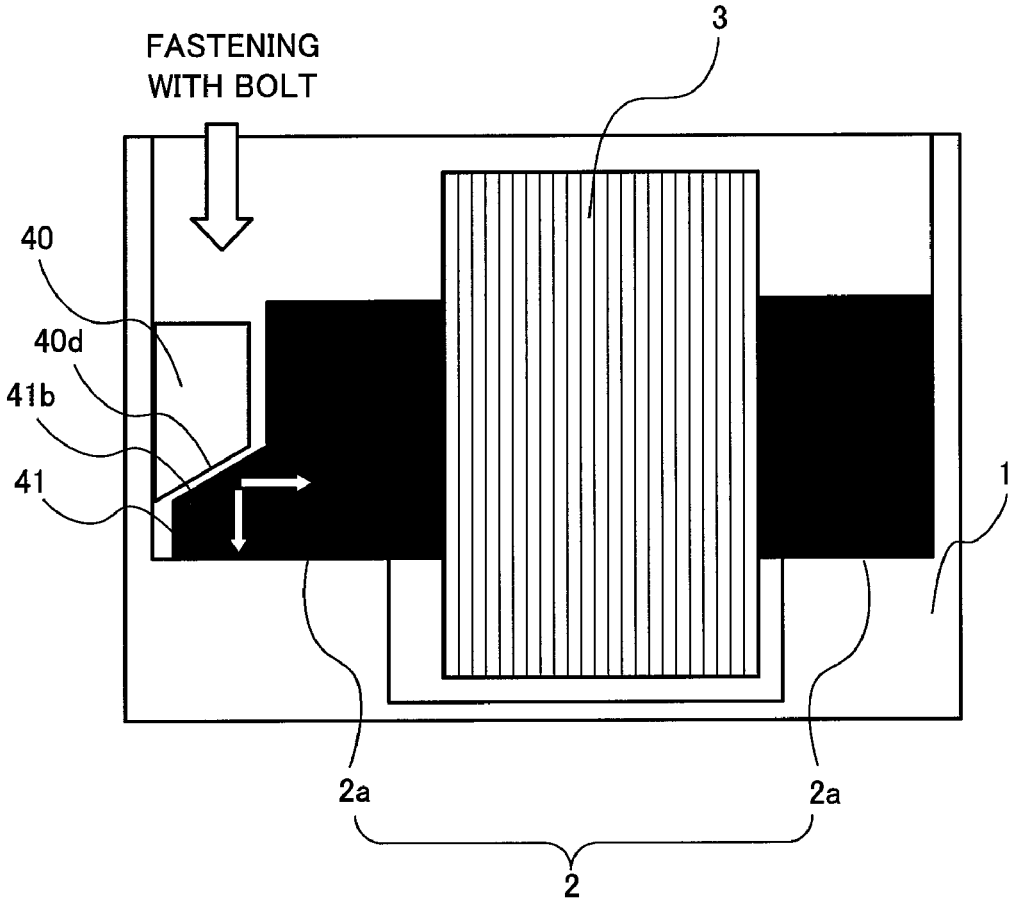
FIG. 13 is a simplified cross-sectional view showing an aspect of the invention in which the slide base is integrated with the core.
Figure 14:
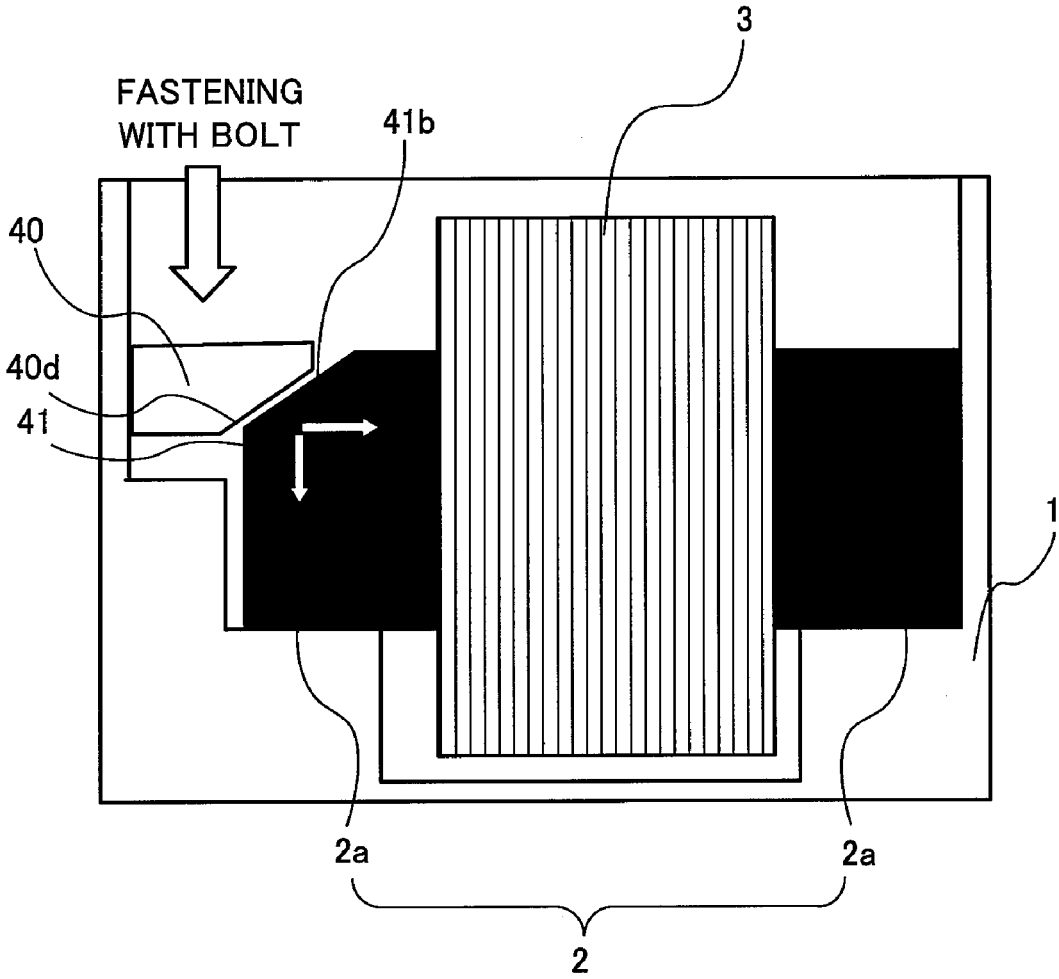
FIG. 14 is a simplified cross-sectional view showing an aspect of the invention in which the slide base is integrated with the core.

Or, as shown in FIG. 13 and FIG. 14, by providing the inclined face 41*b* on the core 2, the core 2 can be made to serve as the slide base 41 as well. In this case, the inclination direction of the inclined face 41*b* is made opposite that in the above aspects, so that the inclined face 40*d* of the slide block 40 impels the inclined face 41*b* of the core 2 in the vertical direction and also in the horizontal direction. By this means, there is no need to provide a first impelling portion 40*a* as in the above aspects, and the structure is further simplified.

Figure 15:
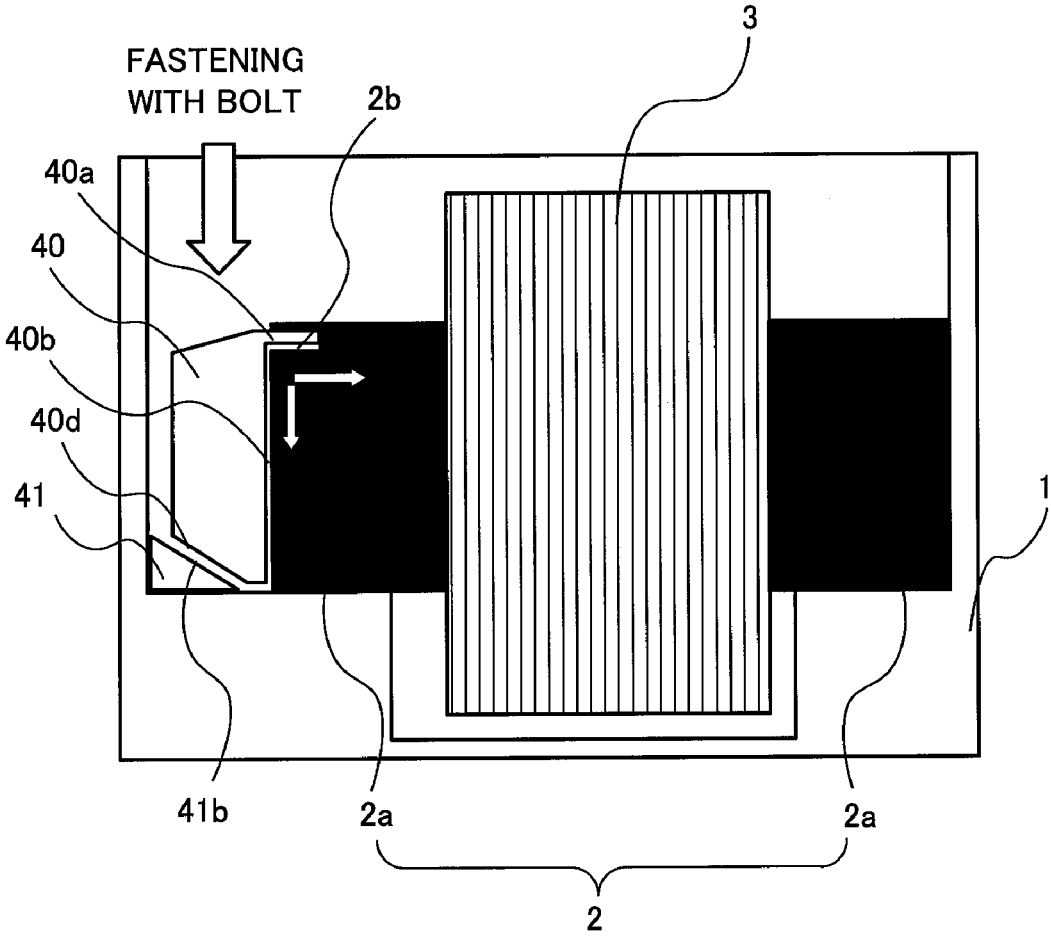
FIG. 15 is a simplified cross-sectional view showing an aspect of the invention in which a latching hole is formed in the core.

Further, as shown in FIG. 15, a latching hole 2*b* may be formed in a portion of the core 2, such that the first impelling portion 40*a* to impel the core 2 from the vertical direction is inserted. As explained above, when modifying the shape of the core 2 itself, a core such as a dust core, which is manufactured by compression molding, is more easily manufactured.

(Regulation of Fixing Bolt)

Figure 16:
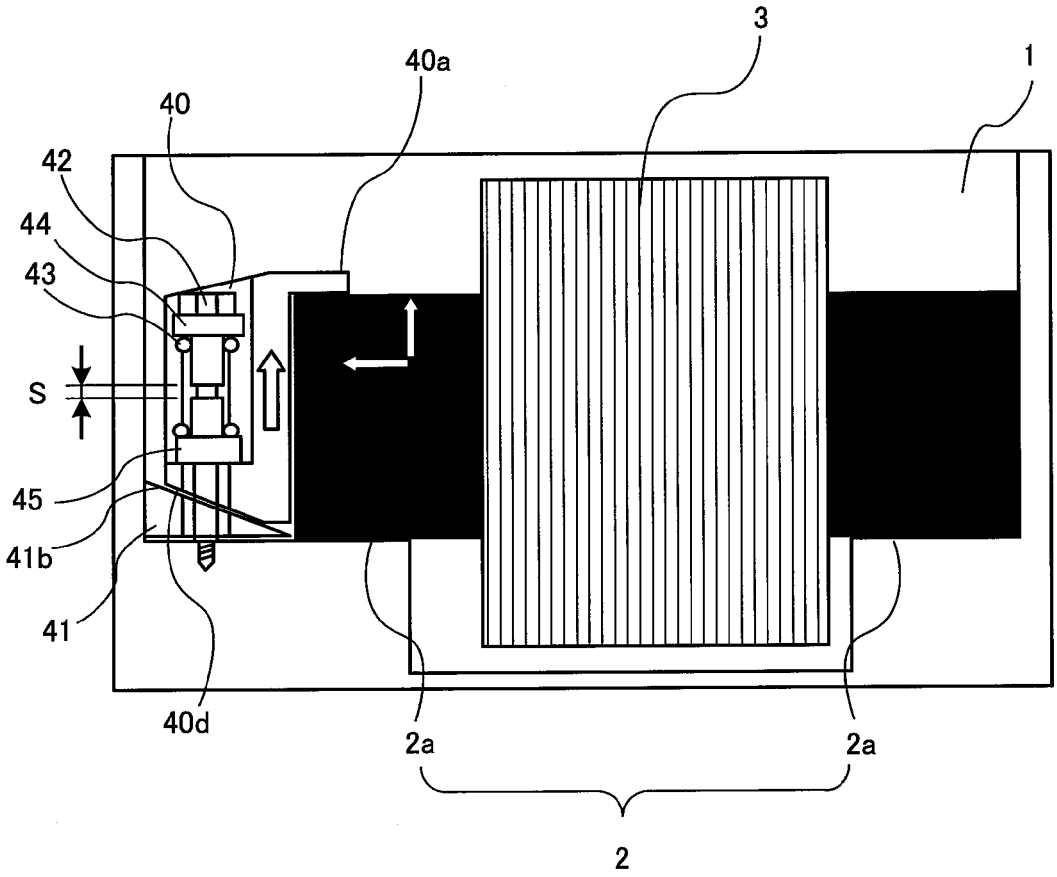
FIG. 16 is a simplified cross-sectional view showing an aspect of the invention in which the stroke of a slide block is regulated by a spacer.
Figure 17:
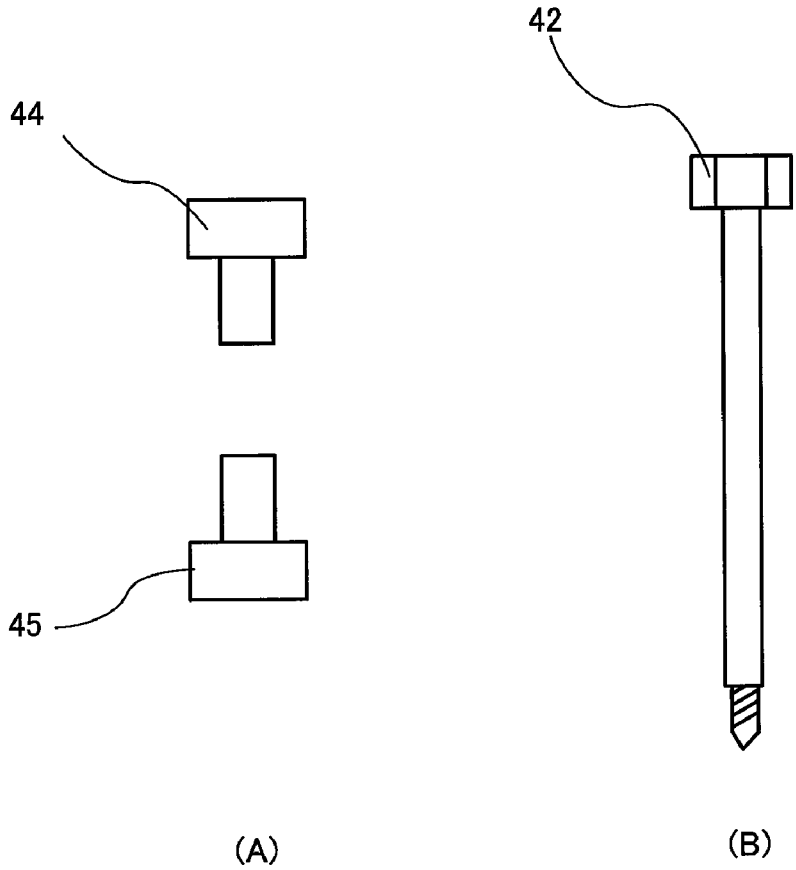
FIG. 17 is a side view showing upper and lower spacers (A) and a fixing bolt (B) in the aspect of FIG. 16.
Figure 18:
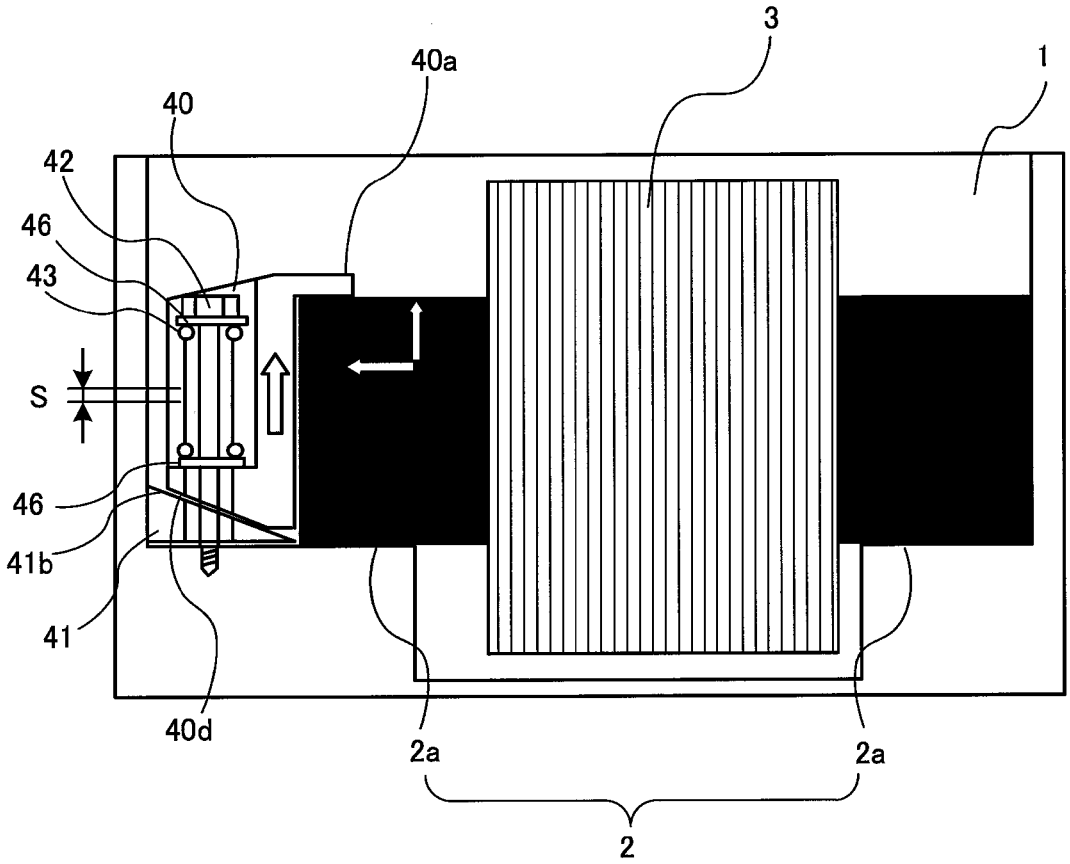
FIG. 18 is a simplified cross-sectional view showing an aspect of the invention in which the stroke of a slide block is regulated by the close-contact height of a coil spring.
Figure 19:
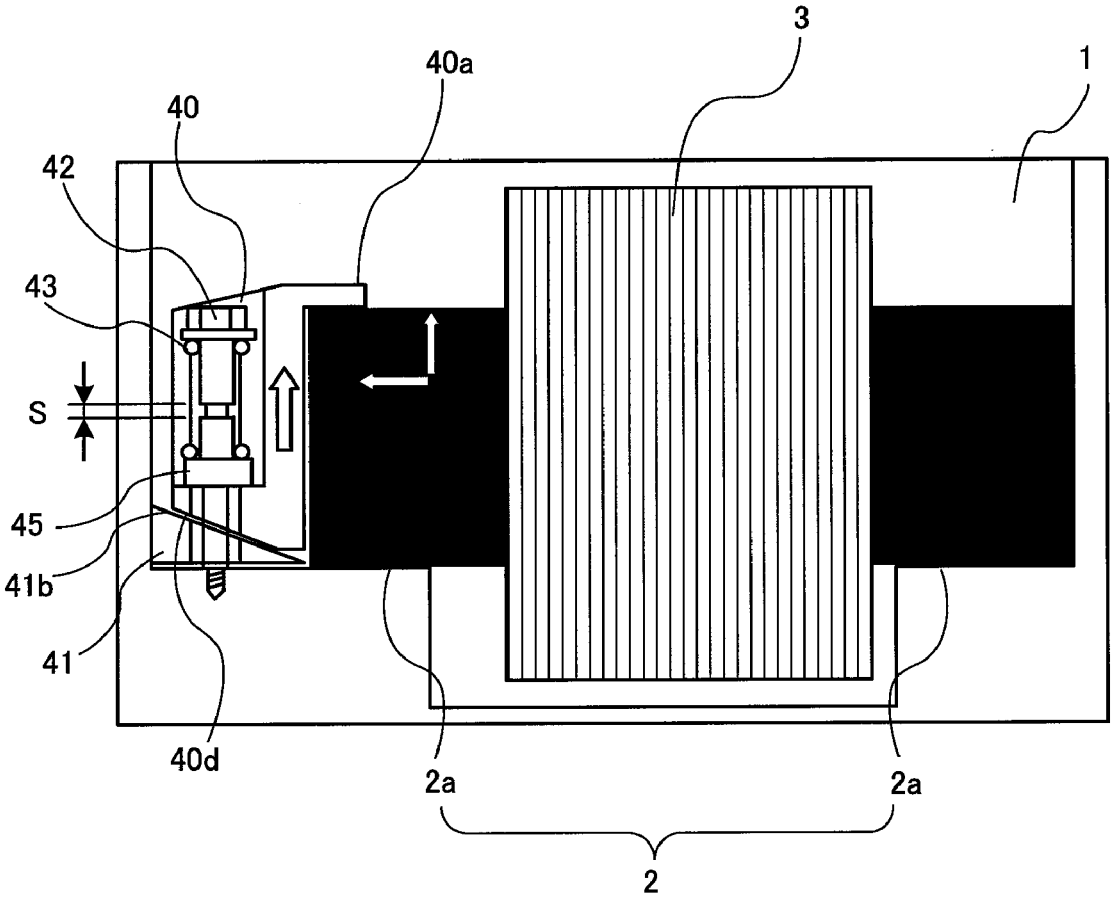
FIG. 19 is a simplified cross-sectional view showing an aspect of the invention in which the stroke of a slide block is regulated by a two-stage shoulder bolt and spacer.

The following is conceivable as a configuration for regulating the fastening of the fixing bolt 42 to a prescribed amount (see S in FIG. 16, FIG. 18, FIG. 19). First, as shown in FIG. 16 and FIG. 17, by inserting a pair of stoppers 44, 45 above and below the coil spring 43 on the fixing bolt 42, regulation occurs at a fixed stroke or greater, regardless of the pressing load on the coil spring 43 due to fastening.

Figure 20:
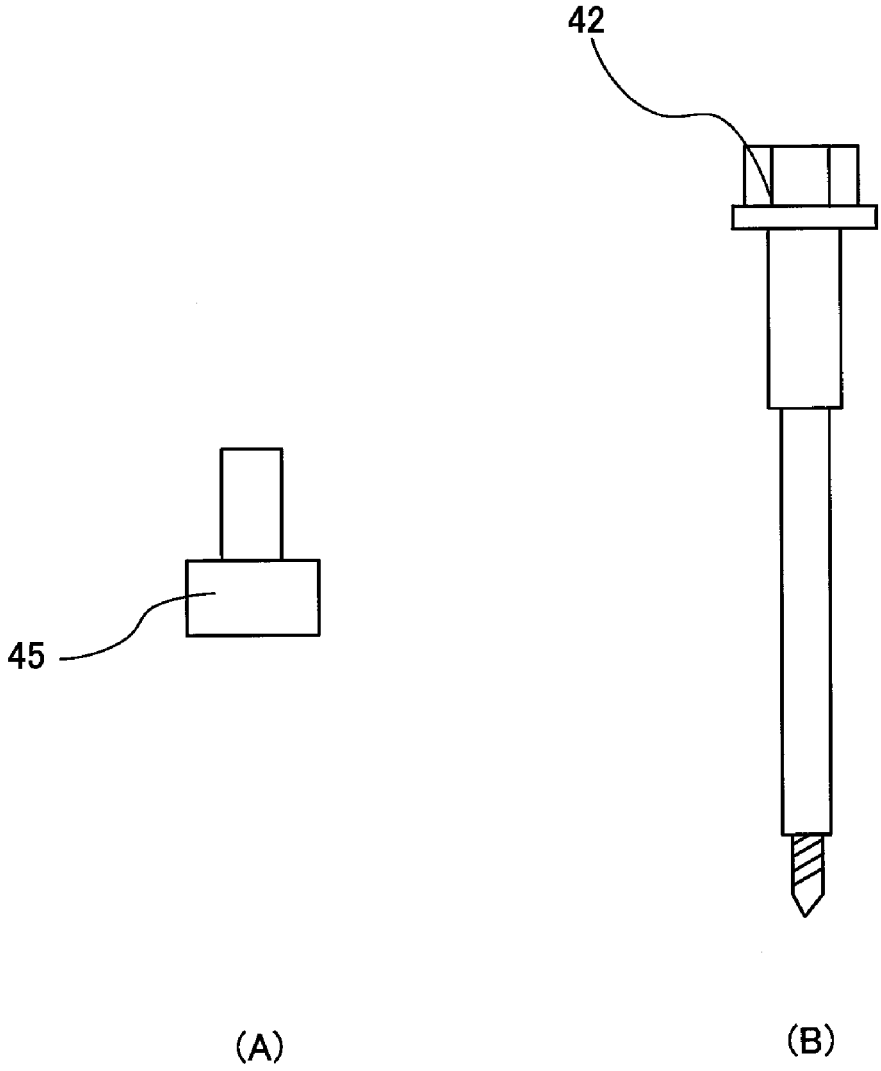
FIG. 20 is a side view showing the lower spacer (A) and the two-stage shoulder bolt (B) in the aspect of FIG. 19.

Further, as shown in FIG. 18, by setting the close-contact height of the coil spring 43 to a desired quantity, the fastening amount can be regulated. And, as shown in FIG. 19 and FIG. 20, by making the fixing bolt 42 a two-stage shoulder bolt, and inserting a stopper 45 only below the coil spring 43, regulation is possible through the abutment of the stopper 45 with the upper portion of the two-stage shoulder bolt.

(Other Modes)

The core and coil may be freely modified. For example, the core shape may be square-columnar, or may be a round rod shape. The core may be formed by adopting either a ceramic (sintered ferrite core) or a metal (compressed-powder core) material; the core material may comprise any arbitrary material. Either a core in which plate-shape members are laminated, or a cut core may be employed.

The coil windings likewise may employ round wire as well as rectangular wire, or Litz wire, in which fine wire is braided, may be used. The coil windings shape may be a cylindrical shape. The number of cores and coils may be chosen arbitrarily.

The size, shape, and material of the abutting member, resolving portion, fixture (fastening member), elastic member, and support member, are likewise not limited to the examples of the above aspects. The block shapes of the abutting member and resolving member may be increased, and the amount of resin further decreased. As the elastic member, a small leaf spring may be used. As the support member also, a housing need not be used. The directions of impelling of the stationary induction apparatus are not limited to precisely vertical or horizontal directions, and need not be vertical or horizontal directions, depending on the circumstances of installation. The first and second impelling directions need not be orthogonal.

Further, the choice of the type of resin to be used for packing is also arbitrary. Any type of resin which is currently used or can be used in future, whether epoxy, polyimide, silicone, or other, may be employed, and the addition of other materials to improve characteristics is also arbitrary. Further, this invention includes application to any stationary induction apparatuses or other components comprising a core and a coil.

The invention claimed is:

1. A stationary induction apparatus fixing structure, in which a stationary induction apparatus is fixed in a case, comprising:

an abutting member, which abuts the stationary induction apparatus; and a fixture, which fixes the abutting member with respect to the case by impelling the abutting member in a vertical direction, a resolving portion, which resolves the impelling force due to the fixture such that the abutting member impels the stationary induction apparatus in the vertical direction and in a horizontal direction, is provided between the abutting member and an inner bottom face of the case;

wherein the abutting member and the resolving portions have inclined portions in mutual contact;

the abutting member has a first impelling portion and a second impelling portion;

the first impelling portion impels an upper portion of the stationary induction apparatus downward such that an under portion of the stationary induction apparatus is pressed against an inner bottom face of the case when the slide block is impelled in a vertical downward direction by the fixture;

the second impelling portion impels one side portion of the stationary induction apparatus in the horizontal direction such that the other side portion of the stationary induction apparatus is pressed against an inner side face of the case when the slid block is impelled in a downward vertical direction by the fixture.

2. The stationary induction apparatus fixing structure according to claim 1, wherein the fixture is a fastening member which fastens and fixes the abutting member with respect to the case.

3. The stationary induction apparatus fixing structure according to claim 1, wherein an elastic member is provided between the abutting member and the fixture.

4. The stationary induction apparatus fixing structure according to claim 1, wherein the abutting member and the resolving portion comprise a pair of block-shape members having inclined faces in mutual contact.

5. The stationary induction apparatus fixing structure according to claim 1, wherein the resolving portion is formed integrally with the case.

6. The stationary induction apparatus fixing structure according to claim 1, wherein the resolving portion is formed integrally with a portion of the stationary induction apparatus.

7. The stationary induction apparatus fixing structure according to claim 1, wherein the fixture is a single member.

8. A stationary induction apparatus fixing member, which fixes a stationary induction apparatus in a case, comprising:

a slide block, which abuts the stationary induction apparatus; and a slide base, provided between the slide block and an inner bottom face of the case, wherein the slide block and the slide base have inclined portions in mutual contact;

the slide block has a first impelling portion and a second impelling portion;

the first impelling portion impels an upper portion of the stationary induction apparatus downward such that an under portion of the stationary induction apparatus is pressed against an inner bottom face of the case when the slide block is impelled in a vertical direction by the fixture;

the second impelling portion impels one side portion of the stationary induction apparatus in a horizontal direction such that the other side portion of the stationary induction apparatus is pressed against an inner side face of the case when the slide block is impelled in a downward vertical direction by the fixture.

9. A stationary induction apparatus fixing structure for securing a stationary induction apparatus within a case, comprising:

a slide block having an upper impelling portion, a side face and a first inclined face, wherein the upper impelling portion is configured to extend over the side face and mount to the stationary induction apparatus;

a slide base having a second inclined face complementary to the first inclined face; and a fixing member operatively connected to the slide block and the slide base to apply a force between the slide block and the slide base to force the upper impelling portion to apply a downward force to secure the starting induction apparatus within the core while forcing the side face to apply a horizontal force when the first inclined face slides across the second inclined face to force the stationary inducting apparatus to move across a bottom of the case.

10. The stationary induction apparatus fixing structure of claim 9, wherein a spring member is connected between the slide block and the fixing member.

11. The stationary induction apparatus fixing structure of claim 9, wherein the fixing member has a distal threaded end and the case has a complementary threaded bore to receive the distal threaded end to secure the slide block and stationary induction apparatus to the bottom of the case.

12. The stationary induction apparatus fixing structure of claim 11, wherein a spring member is connected between the slide block and the fixing member.

13. The stationary induction apparatus fixing structure of claim 11, wherein the stationary induction apparatus includes a coil and a core that extends through the coil and the case has a recess in the bottom configured to enable movement of the coil within the opening and the upper impelling portion is configured to mount above the core to prevent vertical movement of the core in the case and to enable the slide block to force the core horizontally against an opposite vertical inner side face of the case.

* * * * *